US008256776B2

(12) United States Patent
Petell et al.

(10) Patent No.: US 8,256,776 B2
(45) Date of Patent: Sep. 4, 2012

(54) PERFORMANCE PICK

(76) Inventors: John James Petell, Riverside, RI (US); Nicolas Alan Perna, Fairfax, VA (US)

( * ) Notice: Subject to any disclaimer, the term of this patent is extended or adjusted under 35 U.S.C. 154(b) by 23 days.

(21) Appl. No.: 12/804,245

(22) Filed: Jul. 16, 2010

(65) Prior Publication Data

US 2012/0013088 A1 Jan. 19, 2012

Related U.S. Application Data

(60) Provisional application No. 61/271,550, filed on Jul. 22, 2009.

(51) Int. Cl.
*A63C 17/14* (2006.01)

(52) U.S. Cl. ..... 280/11.232; 280/11.222; 280/11.227

(58) Field of Classification Search ..... 280/11.19, 280/11.221, 11.222, 11.226, 11.227, 841, 280/11.232
See application file for complete search history.

(56) References Cited

U.S. PATENT DOCUMENTS 2,570,349 A * 10/1951 Kardhordo ..... 280/11.222
3,693,988 A * 9/1972 Steinhiser ..... 280/11.223
4,844,492 A * 7/1989 Ludwig ..... 280/11.227
5,280,931 A * 1/1994 Horton ..... 280/11.206
5,308,093 A * 5/1994 Walin ..... 280/11.207
5,738,360 A * 4/1998 Petell et al. ..... 280/11.232
6,113,112 A * 9/2000 Kubelka ..... 280/11.231
6,443,463 B1 * 9/2002 Kubelka ..... 280/11.19
2006/0038361 A1 * 2/2006 Sano ..... 280/11.221

* cited by examiner

*Primary Examiner* — J. Allen Shriver, II
*Assistant Examiner* — Bridget Avery

(57) ABSTRACT

A specially formed cylindrical disc, set in a fixed position, to be utilized on the PIC® inline skate to allow for jumps and spins in the sport of inline figure skating. The performance pick disc is made of molded rubber or synthetic material. The purpose of the performance pick is to provide enhanced spins, jumps, and footwork common in the sport of inline figure skating. The continuous curved shape of the performance pick discs outer edges provides a toe-in angle of between 0 and 22 degrees, the optimal angle being between 5 and 12 degrees for jumps and 0 to 5 degrees for spins. In a variation, the outer edges are slanted at an angle between 20 and 45 degrees on both sides continuously around the cylindrically formed disc to provide an optimal surface for push offs common in inline figure skating maneuvers.

2 Claims, 6 Drawing Sheets

PERFORMANCE PICK

CROSS REFERENCE

A provisional application for the invention was filed on Jul. 22, 2009. U.S.P.T.O. No. 61/271,550.

FIELD OF INVENTION

This invention relates to the toe pick (disc) used on the PIC® inline skate, a specially designed inline skate which is the basis of the sport of inline figure skating.

BACKGROUND OF THE INVENTION

At the present time inline figure skaters practice their sport utilizing an inline PIC® skate which employs a 45 mm×29 mm cylindrical pick at the toe of the skate. As with ice figure skates, the pick serves as an end point by which skaters execute a variety of footwork maneuvers including spins as well as for take-offs in the execution of jumps. While an ice blade has a serrated flat edge designed to penetrate ice, the cylindrical pick (disc) of the inline figure skate is blunt.

Reports from inline figure skaters determined that a specially configured cylindrical disc with an outer surface area which engages the skating surface at varying angles would greatly enhance performance by providing a solid point at an angle optimal for the execution of jumps, spins, and footwork maneuvers.

SUMMARY OF INVENTION

In accordance with the present invention, a performance pick disc for inline figure skates provides the skater with the means to execute a wide variety of maneuvers in the sport of inline figure skating.

In general, the invention features a cylindrical disc configured of molded rubber or synthetic material and is designed to fit the PIC® inline skate.

The invention, a 45 mm long×29 mm wide cylindrical disk, is molded to provide a continuous curve on both outer edges which contact the skating surface. The performance pick discs curved profile provides edges that enable skilled skaters to execute a wide range of skating maneuvers, jumps, and spins. In a variation the outer edges have continuous flat slanted edges on both sides of the disc, preferred by skaters for strong push offs.

BRIEF DESCRIPTION OF DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis being placed on the principles of the invention.

DESCRIPTION OF THE EMBODIMENTS OF THE INVENTION

Figure 1:
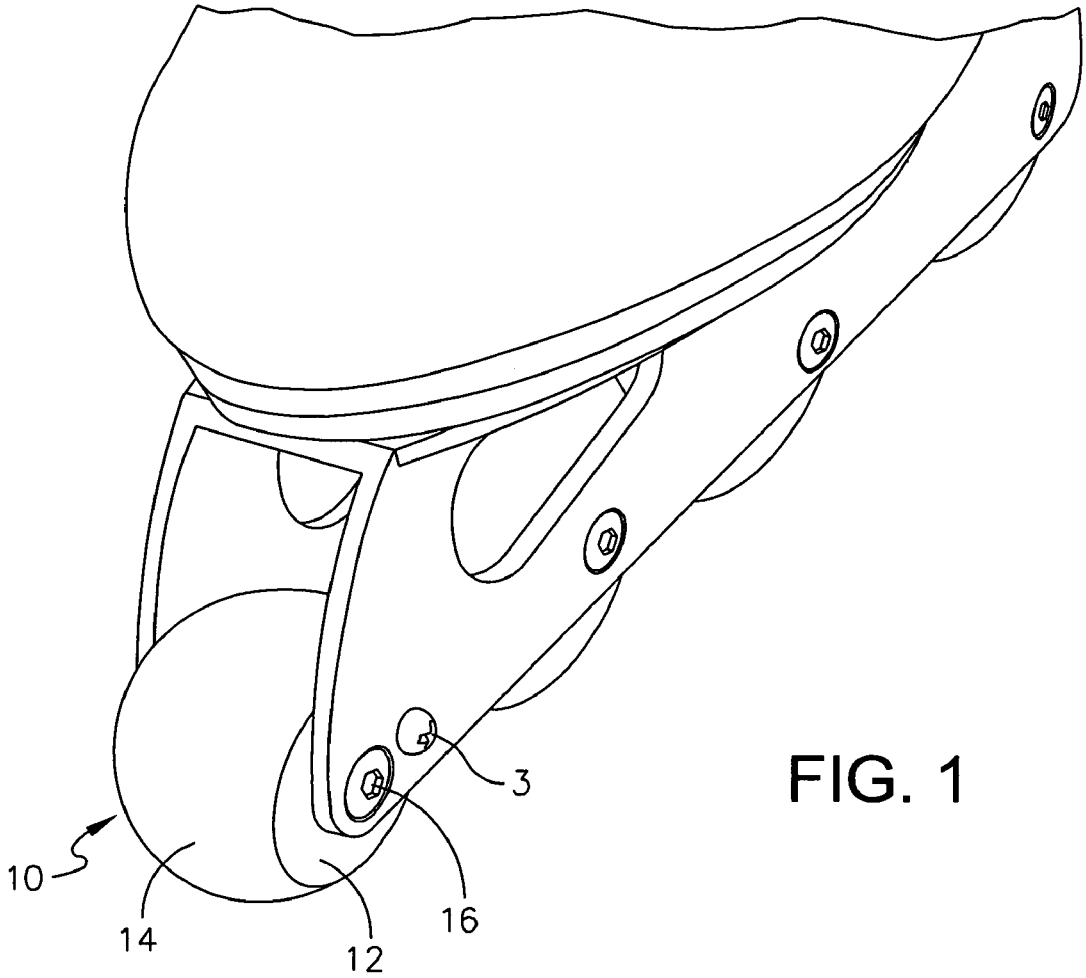
FIG. 1 illustrates use of the performance pick disc in a ¾ view.

Referring to FIG. 1 shows the performance pick disc 10 held fixed by set screw 3 in the jump take-off position: the disk 10, with curved edge 14 is engaged with the surface at an angle of between 5 and 12 degrees. The curved edge 14 begins 16 mm from the center of mounting bolt 16 on the side of the disc 12 to the mid-point which is 22.5 mm from the center 16 and continues symmetrically to the opposite side of the outer surface 12. This curve provides a toe-in contact area of between 0 and 22 degrees from the center of the outer edge 14. The optimal contact angle for jumps is between 5 and 12 degrees. The cylindrical configuration of the disk 10 affords the skater a continuous surface with the optimal contact angle. The additional benefit of the contact angle 14 provides enhanced traction for take-offs. This is especially important when preparing for jumps.

Figure 2:
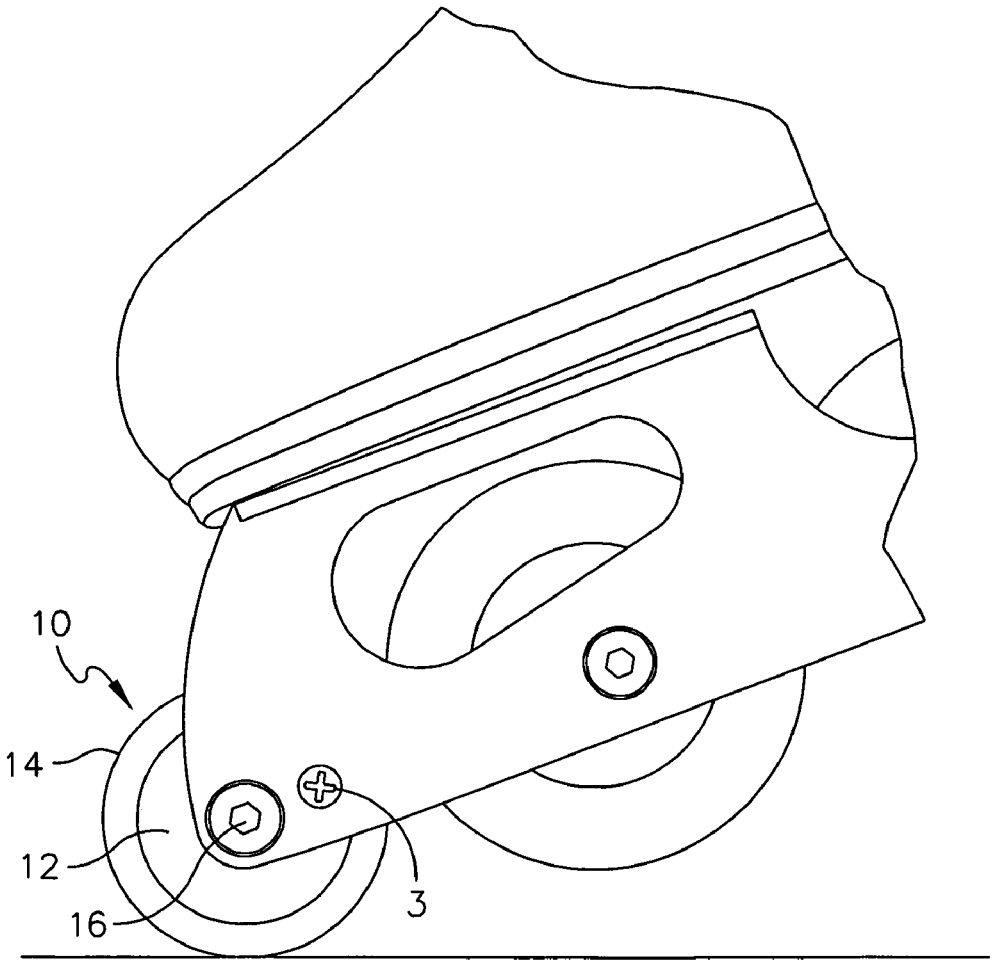
FIG. 2 illustrates use of the performance pick disc in a side view.
Figure 3:
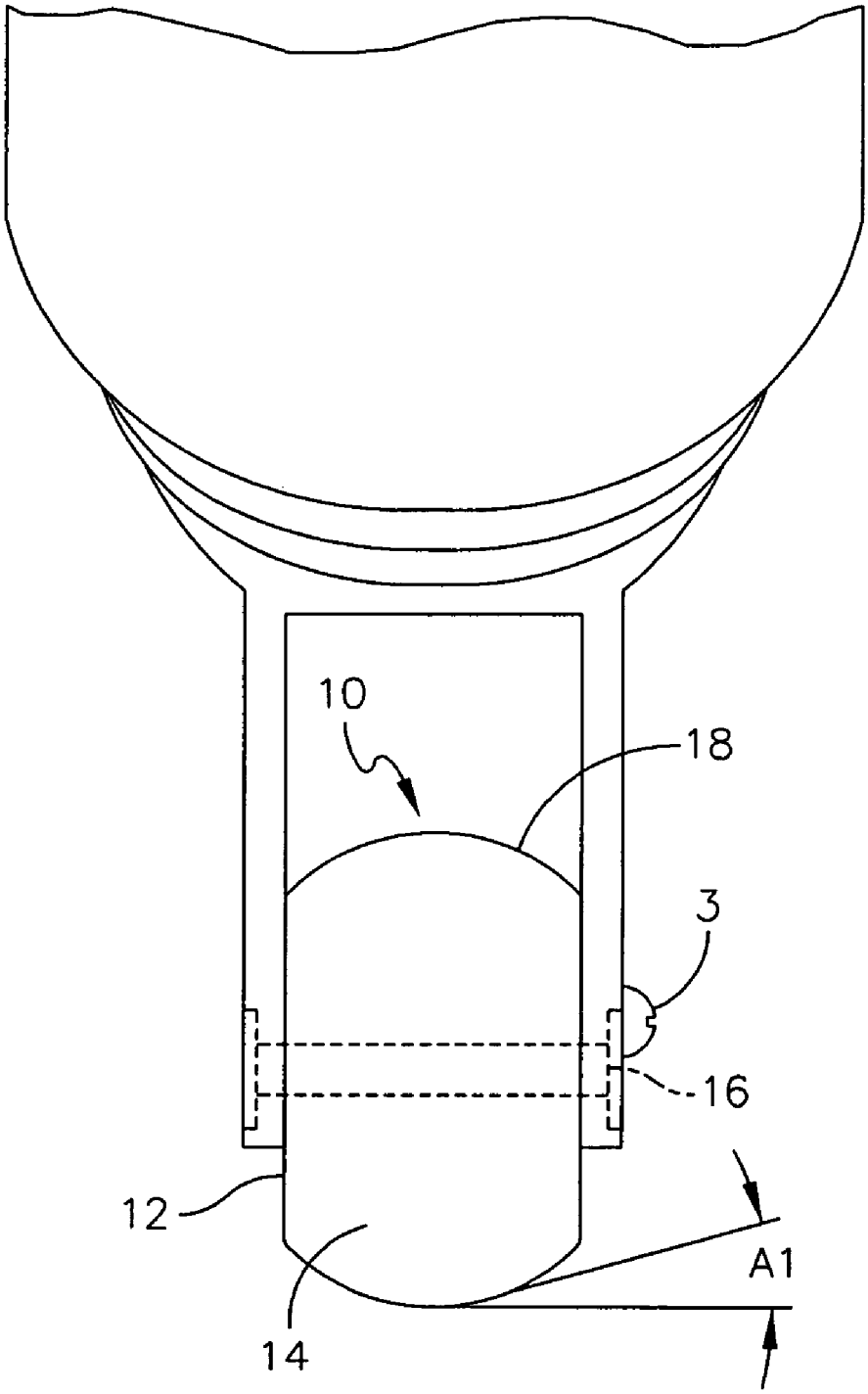
FIG. 3 illustrates use the performance pick disc in a front view.

Referring to FIG. 2, is a side view of the performance pick 10 disk with a graduated symmetrical taper beginning 16 mm from the mounting bolt 16 and curved to the midpoint of the outer surface 14 which is 22.5 mm from the center of the mounting bolt 16 and continues the curve to the opposite edge. Referring to FIG. 3 is a front view of the performance pick 10. The angle A1 is between 0 and 12 degrees. Additionally the curve which extends from 0 to 22 degrees allows for reduced surface contact when engaged at the mid-point 18 referenced in FIG. 4. Optimal spins, common in figure skating, are executed between 0 and 5 degrees.

Figure 4:
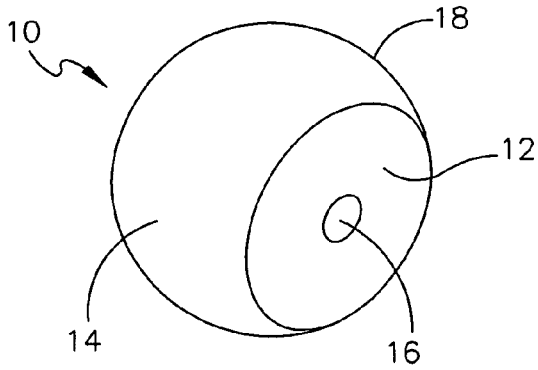
FIG. 4 is a ¾ view of the performance pick disc.

Referring to FIG. 4 is the performance pick disk 10 in a ¾ view and shows the mid point of the contact surface 18. The taper begins 16 mm from the center of mounting bolt 16. The flat surface area 12 is 32 mm from edge to edge.

Figure 5:
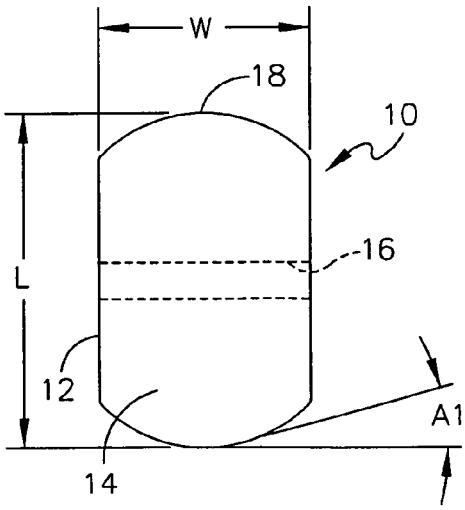
FIG. 5 is a front view of the performance pick disc.

Referring to FIG. 5 as in FIG. 3 the pick is the front view of the disc 10.

Figure 6:
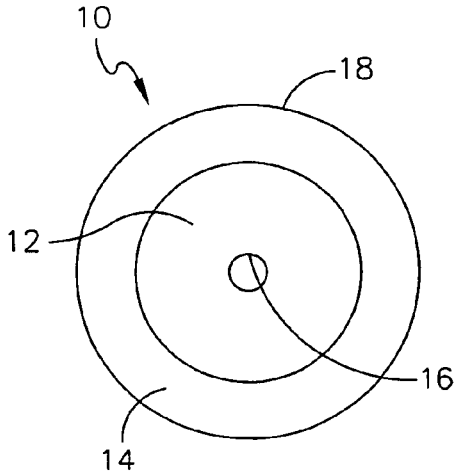
FIG. 6 is a side view of the performance pick disc.

Referring to FIG. 6 is a side view of disc 10.

Figure 7:
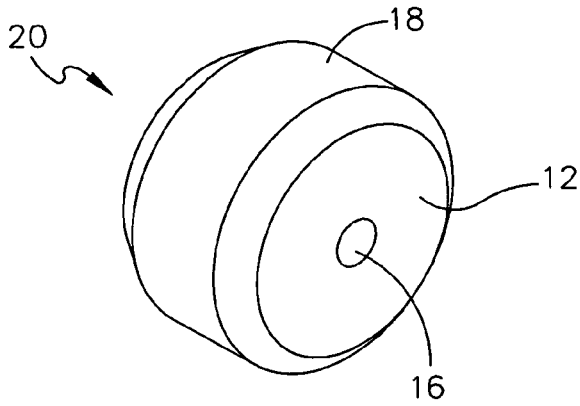
FIG. 7 is a ¾ view of a variation of the performance pick disc.

Referring to FIG. 7 is a ¾ view of the performance pick 20 which features a flat edge at an angle A2 of between 20 and 45 degrees starting 18 mm from the center of the mounting bolt hole 16 and is flat for 5 to 9 mm. This variation is favored by figure skaters that require strong push off points for various foot work maneuvers. The outer surface 18 is between 13 and 17 mm across and continues around the disc.

Figure 8:
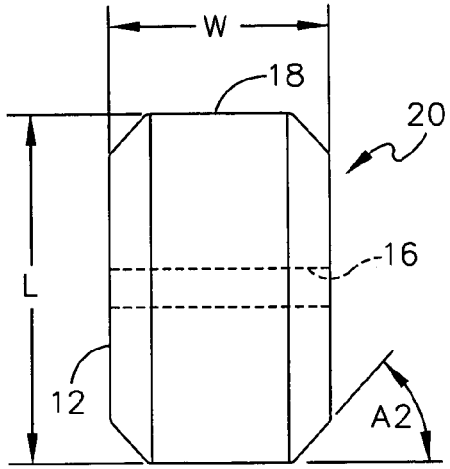
FIG. 8 is a front view of a variation of the performance pick disc.

Referring to FIG. 8 is the front view of the variation of the performance pick disc 20.

Figure 9:
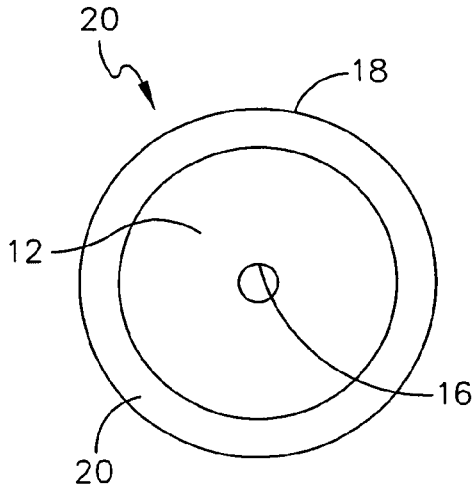
FIG. 9 is a side view of a variation of the performance pick disc.

Referring to FIG. 9 is the side view of the variation of the performance pick disc 20.

Figure 10:
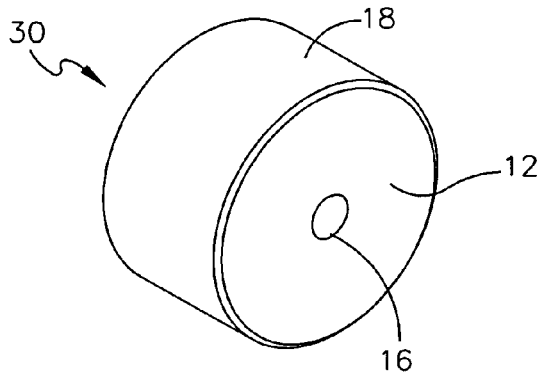
FIG. 10 is a ¾ view of a variation of the performance pick disc.

Referring to FIG. 10 is the ¾ view of the variation of the performance pick 30.

Figure 11:
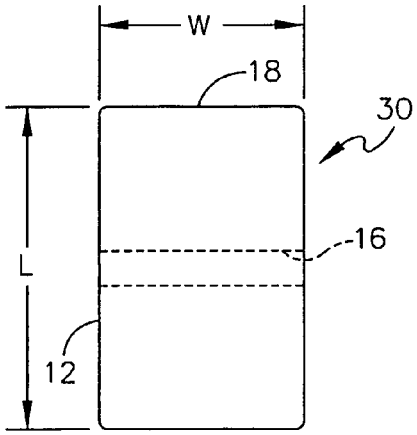
FIG. 11 is front view of a variation of the performance pick disc.

Referring to FIG. 11 is the front view of the variation of the performance pick 30.

Figure 12:
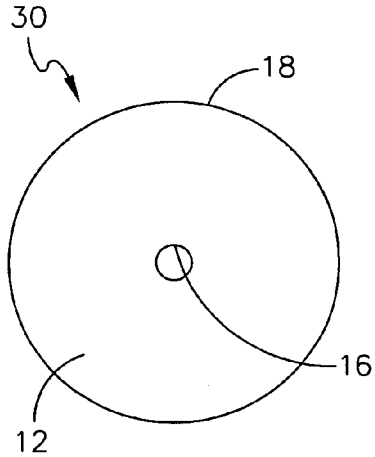
FIG. 12 is a side view of a variation of the performance pick disc.

Referring to FIG. 12 is the side view of the variation of the performance pick 30.

We claim:

1. A performance toe pick disc mounted on an inline skate frame, comprising: the pick disc having a 45 mm diameter with a centered mounting hole, the pick disc being held in a fixed position at a forward distal end of the frame by set screws mounted on both sides of the frame between opposing rails; the pick disc being cylindrical in shape and made of molded rubber or synthetic material and defining an angle of 0 to 22 degrees on either side of the performance pick disc; the pick disc having curved outer edges and a graduated symmetrical taper beginning adjacent the mounting hole; the pick disc having a toe-in angle being between 5 and 12 degrees for jumps and 0-5 degrees for spins; wherein the curved outer edges are tapered reducing surface drag by limiting surface contact of the performance pick disc thereby allowing for more revolutions and quicker spins.

2. The performance pick disc of claim 1 further comprising: a continuous slanted flat edge on both side of the cylindrical performance pick disc starting 18 mm from the center of the mounting hole extending 5 to 9 mm at multiple angles from 5 to 45 degrees, thus allowing for push-offs during the execution of skating maneuvers performed in inline figure skating.

* * * * *